US008556439B2

(12) United States Patent
Eng et al.

(10) Patent No.: US 8,556,439 B2
(45) Date of Patent: Oct. 15, 2013

(54) HOUSEHOLD APPLIANCE INCLUDING INFORMATION LIGHT DEVICE

(75) Inventors: Lindsay Eng, Long Beach, CA (US); Michael Georg Rosenbauer, Reimlingen (DE); Metin Tastan, Dillingen (DE); Ralf Winkler, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 349 days.

(21) Appl. No.: 13/043,504

(22) Filed: Mar. 9, 2011

(65) Prior Publication Data

US 2012/0230049 A1 Sep. 13, 2012

(51) Int. Cl.
*F21V 33/00* (2006.01)

(52) U.S. Cl.
USPC ..... 362/89; 362/555; 362/602

(58) Field of Classification Search
USPC ..... 134/56 D, 57 D; 362/555, 551, 602–605, 362/89–91
See application file for complete search history.

(56) References Cited

U.S. PATENT DOCUMENTS

| | | | | |
|---|---|---|---|---|
| 5,151,884 | A | 9/1992 | Griffith et al. | |
| 5,660,452 | A | 8/1997 | Bales et al. | |
| 5,836,669 | A | 11/1998 | Hed | |
| 6,295,004 | B1 | 9/2001 | Burnett | |
| 6,508,085 | B1 * | 1/2003 | Byrne | 68/3 R |
| 6,837,591 | B2 | 1/2005 | Tufte | |
| 8,157,399 | B2 * | 4/2012 | Leung | 362/97.3 |
| 2006/0232997 | A1 | 10/2006 | Rosenbauer et al. | |
| 2007/0151584 | A1 * | 7/2007 | Omachi et al. | 134/56 D |
| 2008/0106429 | A1 | 5/2008 | Kaczmarek et al. | |
| 2008/0236563 | A1 | 10/2008 | Wilsdorf | |
| 2010/0147338 | A1 * | 6/2010 | Busing et al. | 134/56 D |

FOREIGN PATENT DOCUMENTS

| | | | |
|---|---|---|---|
| DE | 10022206 | A1 | 2/2002 |
| EP | 2189727 | A1 | 5/2010 |
| WO | WO2008073049 | A1 | 6/2008 |

OTHER PUBLICATIONS

Chris Burns, "A Quad of Energy Efficiency," online: http://www.yankodesign.com/2010/06/23/a-quad-of-energy-efficiency/, Jun. 23, 2010.

Electrolux, "Electrolux Insight 60cm Integrated Dishwasher with Light Bar-ESI68850X," online: Appliancedirect.uk.com and Electrolux.com, 2010.

* cited by examiner

*Primary Examiner* — Bao Q Truong
(74) *Attorney, Agent, or Firm* — James E. Howard; Andre Pallapies

(57) ABSTRACT

A household appliance including an information light device that allows a user of the household appliance to determine when the household device is in operation, and a method thereof. The information light device may include a light guide structured to indicate an operating status of the household appliance. The light guide may be disposed at a lower portion of the household appliance, and embodied as a wave guide where at least part of the light that exits the light guide is guided in a direction that is perpendicular to the light guide and onto a floor where the household appliance is disposed.

20 Claims, 5 Drawing Sheets

HOUSEHOLD APPLIANCE INCLUDING INFORMATION LIGHT DEVICE

BACKGROUND OF THE INVENTION

1. Field of the Invention

The present invention relates to a household appliance and more particularly, to a household appliance including an information light device and method thereof that allows a user of the household appliance to determine when the household appliance is in operation or not.

2. Related Art

In the related art, household appliances, such as dishwashers typically generate enough noise that a user may tell by the noise whether or not the dishwasher is in operation. However, some dishwashers may be so quiet that a user cannot hear when the dishwasher is in operation. Therefore, some of these dishwashers currently have an "infolight spot" where a light spot projected from the dishwasher shines on a kitchen floor, indicating that the dishwasher is in operation. When the wash cycle ends and the dishwasher turns off, the dishwasher turns off the infolight spot so that the light spot on the kitchen floor disappears. By the appearance and disappearance of the light spot, the user knows when the dishwasher is in operation or not.

The present invention introduces a household appliance with an information light device referred herein as an "infolight glow", where instead of a light spot, the infolight glow produces a band or stripe of light about as long as a width of the household appliance onto the floor to indicate an operating status of the household appliance.

SUMMARY OF THE INVENTION

A first aspect of the present invention is directed to a household appliance. The household appliance may include an information light device that allows a user of the household appliance to determine when the household device is in operation. In the first aspect, the information light device may include a light guide structured to indicate the operating status of the household appliance. The light guide may be disposed at a lower portion of the household appliance, and embodied as a wave guide where at least part of the light that exits the light guide is guided in a direction that is perpendicular to the light guide and onto a floor where the household appliance is disposed.

A second aspect of the present invention is directed to a method for indicating an operating status of the household appliance. In the second aspect, the method may include the steps of generating light by a light source through a light guide, wherein light exits the light guide in at least a direction that is perpendicular to the light guide.

The illustrative aspects of the present invention are designed to solve the problems herein described and other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various exemplary embodiments of the disclosure, in which.

Figure 1:
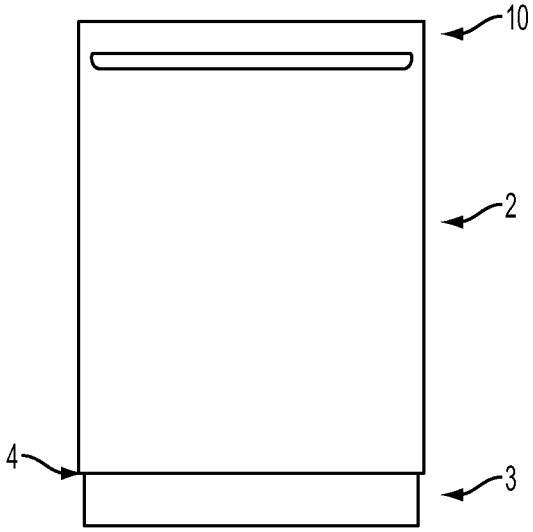
FIG. 1 depicts a household appliance including an information light device known as an "infolight glow" according to an exemplary embodiment of the invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

FIG. 1 shows an exemplary embodiment of a household appliance of the present invention, such as a dishwasher 10. The dishwasher 10 may comprise a door 2 which is suitable for tiltable opening. On a lower side of the door 2, the dishwasher 10 may include a base cover or toe panel 3. The base cover/toe panel 3 may protect a user of the dishwasher 10 from inadvertently accessing a space where the electronics and other functional components (not shown) of the dishwasher 10 may be located, thereby protecting both the user for safety purposes and the electronic components from damage. The dishwasher 10 may further include a door seal 4 plugged onto the base cover/toe panel 3 to seal a space between the door 2 of the household appliance and the toe panel 3.

On a lower side of the door 2 or base cover/toe panel 3, the dishwasher may include an information light device 20 known as an "infolight glow" that produces a band or stripe of light on a floor of the dishwasher across a substantially large width of the dishwasher to indicate an operating status of the dishwasher.

Figure 2:
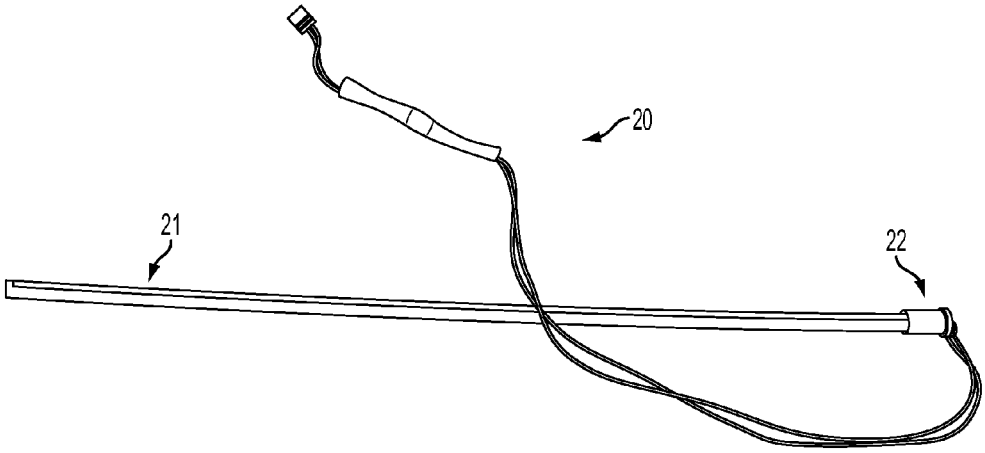
FIG. 2 depicts a light guide according to an exemplary embodiment of the invention.

FIG. 2 depicts an information light device 20 according to an exemplary embodiment of the invention. The information light device 20 may include a housing 21 as a light guide or wave guide as known in the art. A light source 22 may be disposed on at least on one end of the light guide 21, wherein the light source 22 generates light that travels through the light guide 21. The light guide 21 may be structured to allow at least part of the light to exit the light guide 21 in a direction that is perpendicular to the light guide and onto the floor. The light guide 21 may be formed of a side glow fiber or other material known in the art for use as a light guide or wave guide. Further, the light source 22 may be a light-emitting diode (LED).

Figure 3:
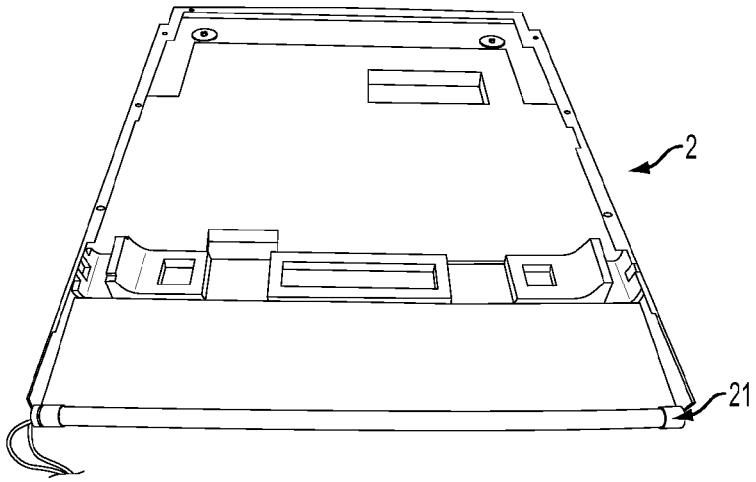
FIG. 3 depicts the light guide of FIG. 2 disposed on an inside at a bottom area of a door of the household appliance according to an exemplary embodiment of the invention.
Figure 4:
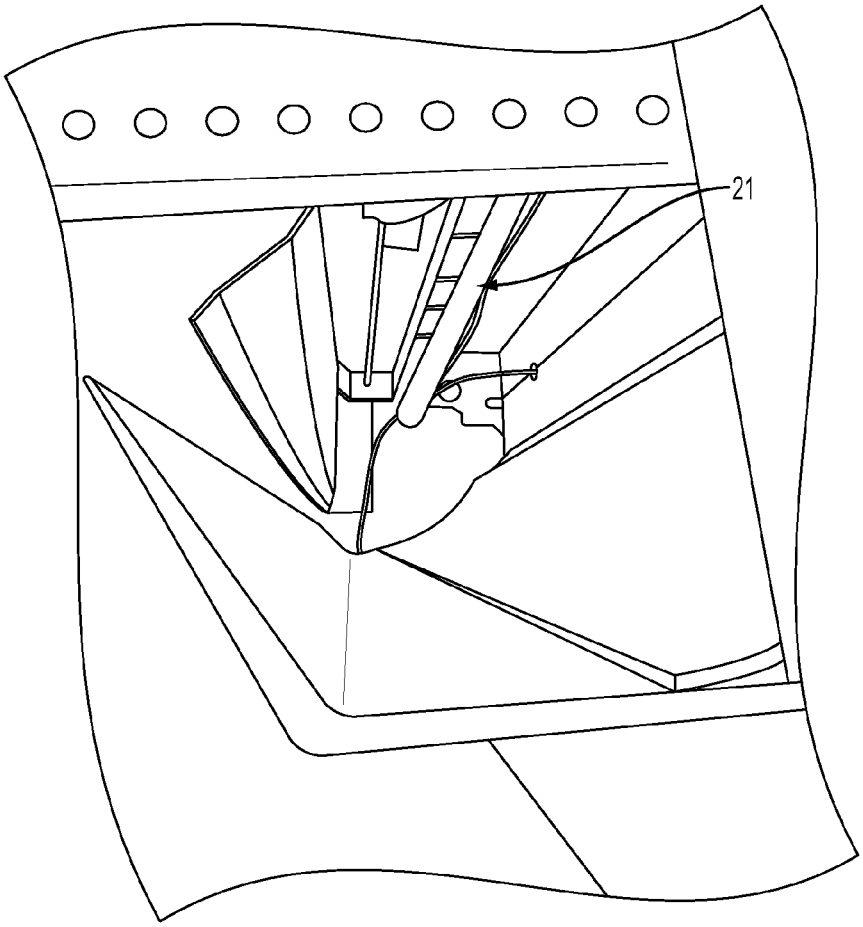
FIG. 4 depicts the light guide of FIG. 2 assembled on a bottom surface of the household appliance, such as on a lower side of a toe panel according to an exemplary embodiment of the invention.

The light guide 21 may be placed on the household appliance in locations that allow for light to shine in a band or stripe of light along the floor on which the dishwasher is disposed. FIG. 3 depicts the light guide 21 disposed on an inside at a bottom area of the door 2. FIG. 4 depicts the light guide 21 assembled on a bottom surface of the dishwasher, such as on a lower side of the toe panel 3. As depicted in FIGS. 3 and 4, the length of the light guide may be about equal to the width of the dishwasher/household appliance 10.

The door seal 4 that seals a space between the door 2 of the dishwasher/household appliance 10 and the toe panel 3 may be formed, for example, from a transparent Polyvinyl chloride (PVC) material that allows the light exiting the light guide 21 to travel from the light guide 21, through the door seal 4, and onto a floor where the household appliance is disposed. Of course, other materials may be used for the door seal 4 that typically include a hard component for support and a soft component for flexibility. Further, in another embodiment of the dishwasher/household appliance 10, the door seal 4 may be disposed of entirely so that the light that perpendicularly exits the light guide 21 shines directly onto the floor.

Figure 6:
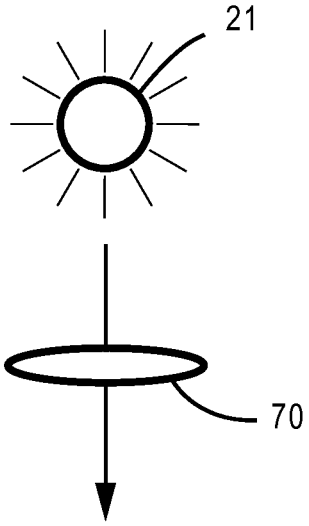
FIG. 6 is a schematic representation of the light guide directing light through a lens.

To ensure that the band or stripe of light along the floor of the dishwasher/household appliance 10 is crisp or clear, one or more lenses 70 may be included to focus the light that exits the light guide 21, as show in FIG. 6.

Figure 5:
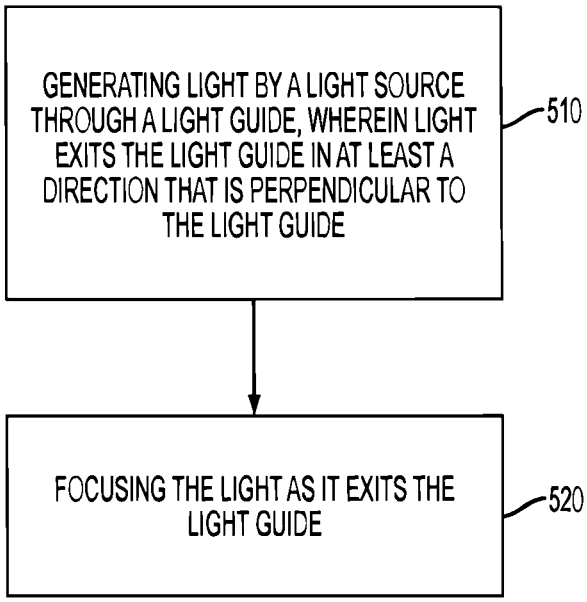
FIG. 5 depicts a method for indicating an operating status of a household appliance according to an exemplary embodiment of the invention.

An exemplary method of the invention is depicted in FIG. 5. In step 510, the method may include generating light by a light source through a light guide, wherein light exits the light guide in at least a direction that is perpendicular to the light guide. In step 520, the method may include focusing the light as it exits the light guide.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A household appliance, comprising:

an information light device including a light source and a light guide, wherein the light source is arranged to generate light that travels through the light guide and is distributed from the light guide, wherein the light guide is arranged to indicate an operating status of the household appliance, wherein the light guide is an elongated member extending along a width of the household appliance such that the light travels through the light guide and along the width of the household appliance, and wherein the light guide is disposed at a lower portion of the household appliance such that when the light is distributed from the light guide the light arranged to appear as a stripe of light on a floor adjacent the household appliance.

2. The household appliance according to claim 1, wherein the light guide is a wave guide.

3. The household appliance according to claim 1, wherein the light source is disposed on at least on one end of the light guide.

4. The household appliance according to claim 3, wherein the light guide is structured to allow at least part of the light to exit the light guide in a direction that is perpendicular to the light guide.

5. The household appliance according to claim 4, further comprising a base cover, and wherein the light guide is disposed on the base cover.

6. The household appliance according to claim 5, wherein the base cover is a toe panel.

7. The household appliance according to claim 6, further comprising a door seal plugged onto the toe panel and structured to seal a space between a door of the household appliance and the toe panel.

8. The household appliance according to claim 7, wherein the door seal is formed from a transparent Polyvinyl chloride (PVC) material that allows the light exiting the light guide to travel from the light guide, through the door seal, and onto the floor where the household appliance is disposed.

9. The household appliance according to claim 3, wherein the light source is a light-emitting diode (LED).

10. The household appliance according to claim 4, further comprising one or more lenses structured to focus the light that exits the light guide.

11. The household appliance according to claim 1, further comprising an outer door, and wherein the light guide is disposed on an inside at a bottom area of the outer door.

12. The household appliance according to claim 1, wherein a length of the light guide is about equal to a width of the household appliance.

13. A method for indicating an operating status of a household appliance, the method comprising the steps of:

generating light by a light source through an elongate light guide such that the light travels through the light guide and along an edge of the household appliance, distributing the light from the light guide in at least a direction that is perpendicular to the light guide such that the light is arranged to appear as a stripe of light on a floor adjacent the household appliance; and indicating an operational status of the household appliance with the light arranged to appear as a stripe of light on the floor.

14. The method according to claim 13, further comprising focusing the light as the light exits the light guide.

15. The method according to claim 13, further comprising focusing the light by one or more lenses, wherein a length of the strip of light is about equal to a width of the household appliance.

16. The method according to claim 13, wherein the light source is a light-emitting diode (LED).

17. The method according to claim 13, wherein the light guide is a wave guide.

18. The method according to claim according to claim 13, wherein the light exiting the light guide in at least a direction that is perpendicular to the light guide travels through a door seal of the household appliance, and onto the floor where the household appliance is disposed.

19. The method according to claim 18, wherein the door seal is formed from a transparent Polyvinyl chloride (PVC) material.

20. The method according to claim 13, wherein the light guide is disposed at a lower portion of the household appliance and extends along a width of the household appliance, and a length of the light guide is about equal to a width of the household appliance.

* * * * *